United States Patent [19]

Rutty et al.

[11] Patent Number: 4,811,862

[45] Date of Patent: Mar. 14, 1989

[54] UNIFIED ASSEMBLY FOR CONTROL OF FLUID FLOW AND A LIQUID DISPENSING SYSTEM WHICH INCLUDES SUCH AN ASSEMBLY

[75] Inventors: Brian R. Rutty, Weybridge; John J. Walshe, Minety, both of Great Britain

[73] Assignee: Arthur Guinness Son and Company Limited, London, Great Britain

[21] Appl. No.: 186,614

[22] Filed: Apr. 27, 1988

[30] Foreign Application Priority Data

Apr. 27, 1987 [GB] United Kingdom ..... 8709910

[51] Int. Cl.[4] ..... F04B 49/00

[52] U.S. Cl. ..... 222/63; 222/61; 417/18; 417/38

[58] Field of Search ..... 222/61, 63; 417/38 X, 417/18 X, 435, 33; 239/124, 126

[56] References Cited

U.S. PATENT DOCUMENTS

| | | | |
|---|---|---|---|
| 3,446,238 | 5/1969 | Norstrud et al. | 417/44 |
| 3,711,222 | 1/1973 | Hartley | 417/44 |
| 3,738,776 | 6/1973 | Debare | 417/38 |
| 3,878,970 | 4/1975 | Nezworski | 222/61 |
| 4,081,621 | 3/1978 | Hartley | 417/38 |

*Primary Examiner*—Andres Kashnikow
*Assistant Examiner*—Karen B. Merritt

[57] ABSTRACT

A liquid dispensing system and a unified assembly for control of fluid flow in such a system has a container 1 from which liquid such as beer is drawn by an electrically controlled pump 2 to be supplied through a unified assembly 4 to a dispensing tap 5. The assembly 4 has an inlet 6 which communicates through a pressure biased non-return valve 8 with a high pressure chamber 9 and an outlet 11 to the tap 5. A piston 14 responds to high pressure in the chamber 9 to be displaced and pivot a rocking lever 26 to operate a microswitch 28 which is normally closed to operate the pump 2 but is opened in response to said displacement of the piston 14 to deactivate the pump 2. A low pressure chamber 35 communicates with the inlet passage 6 and the pressure of liquid in the system expands the chamber 35 to maintain a plunger 38 against its spring biasing. Upon entry of froth or foam into the passage 6 the low pressure thereof permits the chamber 35 to contract under the spring biasing of plunger 38 and displacement of the latter pivots the rocking lever 26 to open the microswitch 28 and deactivate the pump 2. With froth or foam in the passage 6 a normally closed bleed valve 48 is manually displaced to open communication between passage 6 and bleed outlet 47. Displacement of the valve 48 abuts and displaces the plunger 38 against its spring biasing to relieve pressure of the plunger on the rocking lever 26 so that the microswitch 28 reverts to its normal closed condition to operate pump 2 which can draw liquid from a fresh supply to displace the froth or foam from the passage 6 through the bleed outlet 47 and prime said passage with liquid for further dispensing when the bleed valve 48 reverts to its normal closed condition.

20 Claims, 1 Drawing Sheet

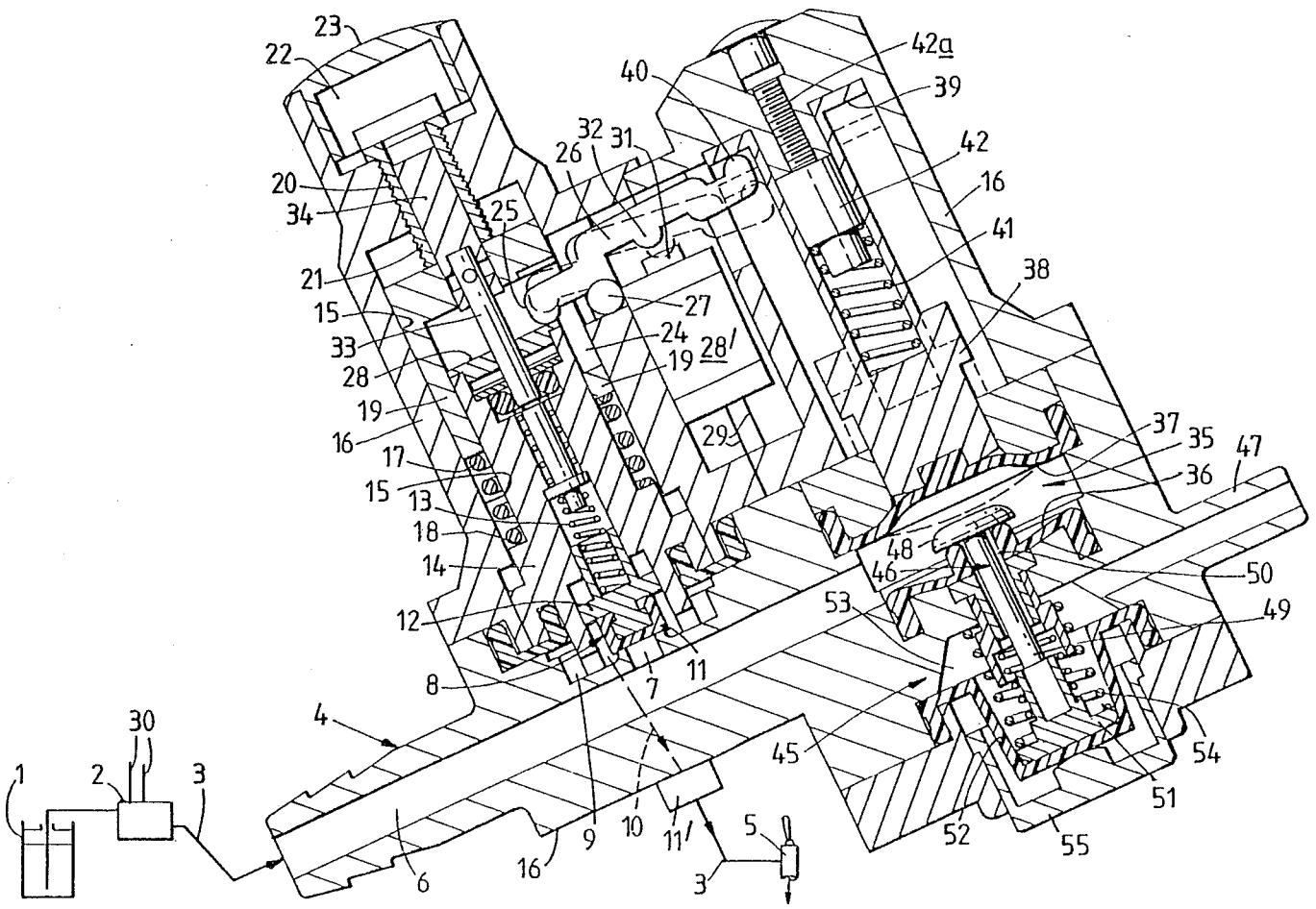
1
2
30
3
4
6
16
9
10
7
11
11'
5
3
45
53
46
48
52
55
51
54
49
50
47
36
35
37
38
41
16
42
39
42a
40
31
32
26
25
27
24
19
28'
29
22
23
20
34
21
15
33
28
19
16
17
15
13
18
14
12
8

UNIFIED ASSEMBLY FOR CONTROL OF FLUID FLOW AND A LIQUID DISPENSING SYSTEM WHICH INCLUDES SUCH AN ASSEMBLY

TECHNICAL FIELD AND BACKGROUND ART

The present invention relates to a unified assembly for control of fluid flow in a liquid dispensing system and to a liquid dispensing system which includes such an assembly. In the dispensing of liquids on demand from an exhaustible source, such as a cask, keg, barrel or other container in the case of beverages, where the liquid is often pumped through lengthy piping to a dispensing tap, there is a problem that as the container empties, air (or other gas as may be used in the dispensing) can be drawn into the piping so that eventually merely bubbles, froth or foam of the liquid are dispensed. When the empty container is recharged with liquid, or replaced by a full container, it is usually necessary to purge the whole length of piping from the container to the dispensing tap of foam before liquid can again be dispensed; this it will be appreciated is both time consuming and inconvenient. Examples of typical beverage dispensing systems in which a considerable length of piping through which beer is supplied from a cask by way of an electrically driven pump to a counter-mounted dispensing tap and in which the aforegoing disadvantages may occur if the cask empties during a dispensing operation are disclosed in our British Patent Specification Nos. 2,172,265A and 2,172,266A.

It is an object of the present invention to provide an assembly for control of fluid flow in a liquid dispensing system of the kind discussed above by which the disadvantages referred to may be alleviated and which assembly may be of a compact unified structure, be reliable, be manufactured in quantity at relatively low cost and be readily installed in existing liquid dispensing systems of the kind referred to. Although the present invention was primarily developed for use in dispensing systems for beverages such as beer, stout, lager, cider and so-called soft drinks which are themselves or have liquid ingredients which are supplied by fluid pressurising means such as a pump from an exhaustible container, it will be realised that the invention may readily be applied to liquid dispensing systems other than for beverages.

STATEMENT OF INVENTION & ADVANTAGES

According to the present invention there is provided a unified assembly for control of fluid flow in a liquid dispensing system and comprising an inlet port and an outlet port; electric switch means for controlling actuation of a fluid pressurising device by which liquid under pressure is intended to be supplied to the inlet port, said switch means having a first condition in which the pressurising device is intended to be operated and a second condition in which the pressurising device is intended to be inoperative; first pressure sensing means which is responsive to fluid pressure at the outlet and reacts when said fluid pressure exceeds a predetermined value to adjust the switch means from its first condition to its second condition; second pressure sensing means which is responsive to fluid pressure at the inlet and reacts when said fluid pressure is less than a second predetermined value to adjust the switch means from its first condition to its second condition, said second predetermined value being less than the first predetermined value; a bleed outlet; a bleed valve normally closing communication between the inlet and the bleed outlet, and a priming facility comprising first means for adjusting the bleed valve to open communication from the inlet to the bleed outlet and second means for adjusting the switch means to its first condition when the fluid pressure at the inlet is less than the second predetermined value.

Further according to the present invention there is provided a liquid dispensing system comprising a unified assembly as specified in the immediately preceding paragraph; a source of liquid to be dispensed; electrically controlled fluid pressurising means controlled by the switch means for supplying liquid under pressure from the source to the inlet of the assembly and a tap communicating with the outlet of the assembly and through which the liquid is to be dispensed.

The fluid pressurising means will usually be in the form of an electrically driven pump by which the liquid is drawn from a container and supplied under pressure to the inlet and which is controlled by a simple on/off micro switch in the unified assembly; for convenience, the pressurising means will hereinafter be referred to as a pump although it will be appreciated that other such means can be utilised such as gas under pressure by which the liquid is displaced from its container where the gas pressure is electrically controlled as required for the supply of liquid to the inlet of the unified assembly.

With the system of the present invention charged with liquid, during normal dispensing such liquid is supplied under pressure from the pump to the inlet of the unified assembly through which it flows to the outlet to be dispensed through the open tap. Under these conditions the pressure of the liquid at the inlet and which is sensed by the second sensing means is arranged to be greater than the second predetermined value so that the second pressure sensing means permits the switch device to be retained in its first condition to operate the pump. Also under these conditions, the pressure of the liquid at the outlet as sensed by the first pressure sensing means is arranged to be less than the first predetermined value so that the first pressure sensing means also permits the switch device to be retained in its first condition to operate the pump. When the dispensing tap is closed, the pressure of liquid at the outlet of the unified assembly rapidly increases until the fluid pressure sensed by the first sensing means exceeds the first predetermined value and that first means reacts to adjust the switch device to its second condition to stop the electric pump (it will be apparent that under these conditions, the fluid pressure sensed at the inlet by the second pressure sensing means will still exceed the second predetermined value of fluid pressure so this second means is without effect on the switch means). When the dispensing tap is opened, the pressure of liquid at the outlet of the unified assembly rapidly decreases until the fluid pressure sensed by the first sensing means becomes less than the first predetermined value and the first means reacts to adjust the switch device to its first condition to start the pump (it will be apparent that under these conditions and provided that the pump starts in its normal manner to restore and maintain pressure, the fluid pressure sensed at the inlet by the second means will still exceed the second predetermined value of fluid pressure so this second means is without effect on the switch means). It will also be realised that the first pressure sensing means effectively acts as a demand control for supply of the liquid as the dispensing tap is opened and closed. When the liquid supply becomes exhausted during dispensing with the tap open, gas or air will be drawn into the system with the result that froth or foam will be supplied from the pump to the inlet of the unified assembly. This causes the fluid pressure at the inlet to decrease rapidly to a value which is less than the second predetermined value as detected by the second pressure sensing means, as a consequence this second means reacts to adjust the switch device from its first condition to its second condition to stop the pump (during this reaction the fluid pressure at the outlet will be less than the first predetermined value so that there is no reaction from the first pressure sensing means to cause an adjustment of the switch device). The rapidity of the reaction from the second pressure sensing means to stop the pump when froth or foam is applied to the inlet is desirably such that the froth or foam is restricted in the conduiting of the system from the container, through the pump and to the part of the unified assembly where the low pressure froth or foam is detected by the second pressure sensing means while the system downstream of the unified assembly can remain charged with liquid. However, it is preferred that the unified assembly includes a non-return valve through which the inlet communicates with the outlet. This non-return valve may be biased, conveniently by adjustable spring means, to alleviate low pressure froth or foam from entering the system downstream of that non-return valve and serves to alleviate liquid in the aforementioned downstream part of the system from flowing into the froth or foam upstream of the non-return valve.

When the source of liquid from which the pump draws has been replenished, it is a feature of the present invention that the system can readily be purged of the froth or foam without discharging the froth or foam through the dispensing tap. To achieve this purging and effective priming of the system in preparation for further dispensing, the bleed valve is operated, preferably manually to open communication between the inlet and the bleed outlet; in addition the switch device is adjusted to its first condition to actuate the electric pump so that liquid is drawn from the source and applied under pressure to the inlet to drive the froth or foam through the bleed outlet. When liquid is observed to emerge from the bleed outlet, the bleed valve is permitted to close communication between the inlet and that outlet and the system is primed for further dispensing by operation of the dispensing tap. As the system is primed as aforementioned, the second pressure sensing means will respond to the increased pressure of the liquid which purges the system of the froth or foam until the fluid pressure sensed by the second pressure sensing means exceeds the second predetermined value and the second pressure sensing means is without effect on the switch device which thereby reverts to a condition to operate the pump. The priming facility can be arranged to adjust the bleed valve to open communication from the inlet to the bleed outlet prior to, simultaneously with, or subsequent to the adjustment of the electrical switch device to its first condition; preferably however the pump starts while the inlet communicates with the bleed outlet or as that communication is being effected. It is also preferred, bearing in mind the aim to achieve a compact and unified assembly, that the second means of the priming facility for adjusting the electrical switch device is manually operable and is effected during operation of the first means of the priming facility to cause a reaction on the second pressure sensing means and that reaction serves to adjust the switch device from its second condition to its first condition and thereby causes the pump to operate.

The switch device is conveniently biased to its first condition and each of the first and second pressure sensing means reacts on the switch to displace it against its biasing and thereby effect the adjustment from its normal first condition (corresponding to the pump being driven) to its second condition (corresponding to the pump being off). With such a biased form of switch device the first and second pressure sensing means preferably comprise biased sensing members which are displaceable in response to variations in fluid pressure at the inlet or outlet as the case may be and the displacement of these members causes an adjustment of the switch device as appropriate. Conveniently the displaceable members of the first and second pressure sensing means control actuation of the switch means through a lever mechanism, preferably a rocking lever which is common to both the first and second pressure sensing means. Usually the biased sensing member of the first pressure sensing means which is displaceable in response to variations in fluid pressure at the outlet will be displaceable under high liquid pressure and against its biasing to adjust the switch device from its first to its second condition while the biased sensing member of the second pressure sensing means which is displaceable in response to variations in fluid pressure at the inlet will be displaceable against low fluid pressure and under its biasing to adjust the switch means from its first to its second condition. Desirably the biasing of the sensing members for the first and second pressure sensing means is adjustable for setting-up the unified assembly to react with required first and second predetermined pressure values.

DRAWINGS

One embodiment of a liquid dispensing system which includes a unified assembly for control of fluid flow in accordance with the present invention will now be described, by way of example only, with reference to the accompanying illustrative drawing which shows the unified assembly in section while the remaining features of the system are shown in schematic form.

DETAILED DESCRIPTION OF DRAWING

The system illustrated schematically is typically that of a simple beverage dispensing system in which, say, beer from a cask 1 is drawn on demand by an electrically driven pump 2 to be supplied by way of a pipe 3 and a unified assembly 4 in the pipe 3 to a conventional open/closed dispensing tap 5. The unified assembly 4 provides a control for beer flow through the system and has an inlet passage 6 connected to the outlet from the pump 2. The passage 6 communicates by way of a port 7 and a non-return valve 8 with a pressure chamber 9. The chamber 9 is in constant communication (as indicated by the broken line 10) with an outlet 11 of the unified assembly and this outlet communicates through the pipe 3 with the dispensing tap 5.

The non-return valve 8 comprises a pad 11 on a carrier 12 which is spring loaded at 13 to normally close the port 7. When beer under adequate pressure is supplied from the pump to the passage 6, the pad 11 is lifted from the port 7 to open communication between that port and the chamber 9 from which beer can flow to the tap 5.

The chamber 9 is associated with a high pressure sensing device and is partly defined by a piston 14 which is displaceable in a piston cylinder 15 formed in a housing 16 of the assembly and which is spring loaded at 17 in a sense to contract the chamber 9. The spring 17 reacts between a shoulder 18 of the piston and a cup 19 in the piston cylinder. The cup 19 is preferably restrained from rotation within the cylinder 15 but is axially adjustable along the cylinder by a screw thread mechanism 20 which connects a tubular stem 21 on the cup 15 with the housing 16. Access to the mechanism 20 for adjusting the axial position of the cup 19 within the piston cylinder is achieved through a port 22 which is normally closed by a removable cap 23. It will be appreciated that axial displacement of the cup 19 serves to adjust the biasing force exerted by the spring 17 on the piston. Projecting radially into the piston cylinder 15 and through an opening 24 in the wall of cup 19 is an end 25 of a rocking lever 26 which is pivotally mounted at 27 on the housing 16. The end 25 of the rocking lever is located to abut an end face 28 of the piston 14 axially remote from the pressure chamber 9 so that during axial displacement of the piston in a sense to increase the volume of chamber 9 causes the lever 26 to rock in a clockwise direction (as shown in the drawing) about the pivot 27. The rocking lever 26 controls operation of a microswitch 28 carried by the housing 16.

The microswitch 28 has terminals 29 which are incorporated with terminals 30 of the electrical pump 2 and with a power source (not shown) in a circuit which serves to control the on/off operation of the pump 2. The switch 28 operation is determined by a displaceable plunger 31 of the switch which is spring loaded to be urged outwardly of the switch body and into a first condition of the switch in which the electrical circuit is normally closed and the pump 2 operates. Depression of the plunger 31 against its spring loading moves the switch 28 into a second condition where the electrical circuit is open and the pump 2 is inoperative. Movement of the plunger 31 is effected through an abutment 32 on the rocking lever 26 which is on the side of the pivot 27 remote from the lever end 25. With the pressure chamber 9 under low pressure and contracted as would occur when the tap 5 is open or opened for dispensing, the spring loading of the plunger 31 and its abutment with the lever 26 biases the lever about the pivot anticlockwise to the position shown by the full lines in the drawing so that the lever end 25 abuts the end face 28 of the piston and the switch 28 will be in its first, closed, condition whereby the pump 2 will supply beer under pressure to the unified assembly 4.

During normal dispensing of beer with the tap 5 open, beer under pressure from the pump 2 entering the inlet passage 6 will lift the non-return valve pad 11 from its seating on the port 7 to enter the chamber 9 and thereby flow to the dispensing tap (while the chamber 9 is maintained in a contracted condition by the pressure biasing of spring 17 on the piston 14). When the tap 5 is closed following a dispensing operation and with the pump 2 operative, the pressure of beer within the passage 6 and thereby in the pressure chamber 9 will rapidly increase to cause the piston 14 to be displaced axially in its cylinder against the biasing of spring 17. This axial displacement causes the lever 26 to be rocked about the pivot 27 in a clockwise direction to the position shown by the broken lines by abutment of the face 28 of the piston with the lever end 25; the plunger 31 is thereby depressed to move the switch 28 into its second, open, condition to stop the pump 2. The piston 14/lever 26 sensing device thus act as a demand control for dispensing.

It will be noted that the spring loaded carrier 12 of the non-return valve 8 is conveniently mounted coaxially within a bore of the piston 14 and the biasing spring 13 of the carrier 12 reacts against a rod 33 which is axially adjustable within the coaxial bore of the piston 14. The end of the rod remote from the valve 8 connects with a shaft 34 which screw threadedly engages with the bore of the tubular stem 21 on the cup 19 so that the axial position of the rod 33 can be adjusted relative to the cup 19. The rod 33 is in sealed sliding engagement with the piston 14 so that the piston can be displaced axially independently of the rod 33; it will be appreciated that by axial adjustment in the position of the rod 33 the biasing force exerted by the spring 13 on the non-return valve can be adjusted. This latter adjustment being effected through the port 22 and by rotation of the shaft 34 within the stem 21.

Communicating with the inlet passage 6 and upstream of the non-return valve 8 is a low pressure detection chamber 35 formed between a pair of opposing flexible diaphragms 36 and 37 having flanged outer peripheries which are sealed to the housing 16. The central region of the diaphragm 37 is connected to the end of a generally cylindrical plunger 38 which is displaceable in the housing 16 substantially parallel with the piston 14 and is located on the side of the microswitch plunger 31 remote from the piston 14. The end of the plunger 38 remote from the diaphragm 37 has an external flange 39 which is capable of abutment with an end 40 of the rocking lever 26, said end 40 being on the side of the switch plunger 31 remote from the pivot 27. The plunger 38 is biased axially by a spring 41 in a tubular part of that plunger and relative to the housing 16 in a sense to contract the chamber 35 (so that the diaphragm 37 is urged towards the diaphragm 36). The relationship between the flange 39 and end 40 of the rocking lever is such that if the plunger 38 is displaced under its spring loading to the end of travel permitted for the plunger 38 (as indicated by the broken lines in the drawing), the rocking lever 26 will be displaced about the pivot 27 in a clockwise direction (as shown by the broken lines) to depress the plunger 31, switch off the pump 2, and thereby provide a control for the pump which is independent of the piston 14 when the chamber 9 is in a contracted condition. The biasing force exerted by the spring 41 on the plunger 38 is adjustable by rotation of a screw threaded rod 42 relative to the housing 16 with which it screw threadedly engages at **42*a* and which rod is located within the tubular part of the plunger 38 so that its end reacts against the spring 41**.

With beer supplied to the inlet passage 6, the pressure within the chamber 35 is sufficient to displace the diaphragm 37 and thereby the plunger 38 against the spring biasing 41 to the position shown in the drawing and the spring biasing is adjusted accordingly. With the pressure chamber 9 in a contracted condition during a dispensing operation, the rocking lever 26 has sufficient clearance beneath the flange 39 to be displaced, under the biasing force of the switch plunger 31, for the switch to be in its first condition in which the pump is operative. Furthermore, when dispensing ceases and pressure develops in the chamber 9 to displace the piston 14 upwardly in the drawing, the rocking lever 26 can pivot to depress the plunger 31 and thereby switch off the pump 2 while the beer pressure in the chamber 35 is adequate to maintain that chamber in its expanded condition and thereby the plunger 38 in the position drawn.

As the cask 1 empties during dispensing, a mixture of beer and gas (usually one or more of air, nitrogen or carbon dioxide gases) will eventually be drawn into the pump and supplied as froth or foam to the inlet passage 6 and low pressure detection chamber 35. It is a usual condition of liquid pumps that their pressure performance when pumping gas, froth or foam is less than when pumping liquid. This froth or foam will then provide a relatively lower pressure in the chamber 35 than that provided by the normal through-flow of beer and this low pressure is inadequate to maintain the diaphragm 37 and plunger 38 against the force of the biasing spring 41. In these circumstances the plunger 38 under the effect of its biasing spring 41 is displaced downwardly in the drawing so that the diaphragm 37, the plunger 38 and its flange 39 move to the positions indicated by the broken lines. During this movement the flange 39 abuts the end 40 of the rocking lever 26 to displace that lever clockwise in the drawing about the pivot 27 and thereby depress the microswitch plunger 31 which turns off the pump 2. This sensing of the low pressure froth or foam in the chamber 35 and the deactivation of the pump 2 is extremely rapid and preferably occurs prior to froth or foam entering the pressure chamber 9 through the port 7. However, it is also preferred that the spring loading on the non-return valve 8 is adjusted so that the low pressure of the froth or foam is inadequate to lift the non-return valve from its seating thereby ensuring that the froth or foam is retained in the system upstream of the non-return valve.

When the empty cask 1 is replaced by a full cask, the froth or foam in the system between the beer in the cask and the non-return valve 8 has to be removed before beer can again be dispensed through the tap 5 and for this purpose the unified assembly 4 includes a priming facility shown generally at 45. This facility comprises a bleed valve 46 which is manually operable to open and close communication between the low pressure detection chamber 35 and a bleed outlet 47 in the housing. The bleed valve 46 has a mushroom valve member 48, the stem 49 of which extends through a port 50 in the diaphragm 36 coaxially with the plunger 38. The stem 49 has a flanged end 51 remote from its mushroom head which is seated within a sealing member 52 sealed to the housing 16. The sealing member 52 forms a chamber 53 with a recess in the housing 16 and the bleed outlet 47 is in constant communication with the chamber 53. A spring 54 reacts between the housing 16 and the flanged end 51 of the mushroom valve to bias the mushroom head into sealing engagement with the diaphragm 36. The port 50 is thereby normally closed to communication with the chamber 35 and the latter is thus normally closed to communication with the bleed outlet 47. Movably mounted on the housing is a cup 55 which abuts the seal 52 and therethrough bears on the flanged end 51 of the mushroom valve stem. The cup 55 presents a button which is manually displaceable to lift the mushroom valve member in the drawing and against the spring loading 54 to open communication between the chamber 35 and the port 50 thereby permitting the froth in the inlet passage 6 to communicate with the bleed outlet 47.

To ensure that the system upstream of the non-return valve 8 is purged of froth or foam when the inlet passage 6 communicates with the bleed outlet 47, the priming facility 45 includes means whereby the pump 2 will operate to draw beer into the system from the cask 1 and thereby drive the froth or foam from the inlet passage, through the open port 50 and to the bleed outlet 47. With this in mind the manual displacement of the mushroom valve 48 against its spring biasing and to open the port 50 is arranged to be sufficient for the mushroom head of the valve to abut the diaphragm 37 (when that diaphragm is in the position shown by the broken line) and displace that diaphragm together with the plunger 38 against the biasing force of the spring 41 so that the diaphragm 37 and its plunger revert to the position shown in the drawing. In this latter position the spring loading of the microswitch plunger 31 displaces that plunger outwardly of the microswitch to pivot the rocking lever 26 in a counter-clockwise direction in the drawing (that is from the position shown by the broken line to that shown by the full line of the rocking lever) so that the microswitch reverts to its normal first condition and the pump 2 is switched on. Beer is now drawn into the system to displace the froth or foam through the bleed outlet 47 and the mushroom valve is maintained depressed until beer is observed to emerge from the bleed outlet 47. The button 55 can now be released so that the mushroom head reverts to its normal condition to close the port 50 while the pressure of beer in the inlet passage 6 and chamber 35 retain the latter chamber in an expanded condition and the plunger 38 against its spring biasing in the position shown. The system is now in a condition for normal dispensing through the tap 5.

It will be apparent that to alleviate wastage of beer and facilitate rapid purging of the froth or foam, it is desirable that the lengths of piping between the cask and the pump 2 and between the pump and the inlet passage 6 are as short as convenient, possibly with the unified assembly 4 being mounted on the pump 2. It will also be apparent that during the purging of froth or foam from the system and the priming of the system as discussed above, the non-return return valve 8 alleviates beer in the system downstream thereof from flowing into the inlet passage 6.

In the above described embodiment we have referred to the piston 14 as being axially slidable over the rod 33 while the latter is screw adjustable within the tubular stem 21 for the purpose of adjusting the spring biasing 13.

In a modification however the rod 33 may be axially slidable within the tubular stem 21 and in screw threaded engagement with the bore of the piston 14 so that rotation of the rod 33 in the piston adjusts the biasing force exerted by the spring 13 on the non-return valve. In this latter arrangement it will be apparent that the rod 33 will be displaced axially in unison with the piston 14 and that the biasing force exerted by the spring 13 will vary during axial displacement of the piston 14. However, this will not result in any change in operation of the system since upon the entry of low pressure froth or foam into the inlet passage 6 the piston 14 will be in a position where the pressure chamber 9 is contracted and the force exerted by the biasing spring 13 will be adjusted for this particular condition. It will also be realised that there will be a distinct pressure differential between the high pressure required to displace the piston 14 against its spring loading to switch off the pump 2 and the low pressure at which the plunger 38 will be displaced under its spring loading to switch off the pump 2.

We claim:

1. A unified assembly for control of fluid flow in a liquid dispensing system and comprising an inlet port and an outlet port; electric switch means for controlling actuation of a fluid pressurising device by which liquid under pressure is intended to be supplied to the inlet port, said switch means having a first condition in which the pressurising device is intended to be operated and a second condition in which the pressurising device is intended to be inoperative; first pressure sensing means which is responsive to fluid pressure at the outlet and reacts when said fluid pressure exceeds a predetermined value to adjust the switch means from its first condition to its second condition; second pressure sensing means which is responsive to fluid pressure at the inlet and reacts when said fluid pressure is less than a second predetermined value to adjust the switch means from its first condition to its second condition, said second predetermined value being less than the first predetermined value; a bleed outlet; a bleed valve normally closing communication between the inlet and the bleed outlet, and a priming facility comprising first means for adjusting the bleed valve to open communication from the inlet to the bleed outlet and second means for adjusting the switch means to its first condition when the fluid pressure at the inlet is less than the second predetermined value.

2. An assembly as claimed in claim 1 and comprising nonreturn valve means through which the inlet communicates with the outlet.

3. An assembly as claimed in claim 2 in which the nonreturn valve means is biased to a normally closed condition and said biasing is adjustable.

4. An assembly as claimed in claim 1 in which the first and second means of the priming facility are associated with each other whereby operation of the priming facility causes an adjustment in the bleed valve to open communication from the inlet to the bleed outlet prior to the adjustment of the electrical switch means to its first condition.

5. An assembly as claimed in claim 1 in which the first and second means of the priming facility are associated with each other whereby operation of the priming facility causes an adjustment in the bleed valve to open communication from the inlet to the bleed outlet simultaneously with the adjustment of the electrical switch means to its first condition.

6. An assembly as claimed in claim 1 in which operation of the second means of the priming facility results from a reaction of that means on the second pressure sensing means to adjust the switch means from its second to its first condition.

7. An assembly as claimed in claim 1 in which the priming facility is manually operable.

8. An assembly as claimed in claim 1 in which the first pressure sensing means comprises a biased sensing member which is responsive to fluid pressure at the outlet and reacts by displacement against its biasing when said fluid pressure exceeds the first predetermined value to adjust the switch means from its first to its second condition.

9. An assembly as claimed in claim 1 in which the second pressure sensing means comprises a biased sensing member which is responsive to fluid pressure at the inlet and reacts to be displaced under its biasing when said fluid pressure is less than the second predetermined value to adjust the switch means from its first to its second condition.

10. An assembly as claimed in claim 9 in which operation of the second means of the priming facility results from a reaction of that means on the second pressure sensing means to adjust the switch means from its second to its first condition and, during operation of the priming facility, the second means of that facility causes a displacement of the biased sensing member of the second sensing means in a direction against its biasing to adjust the switch means from its second condition to its first condition.

11. An assembly as claimed in claim 9 in which the second pressure sensing means comprises a diaphragm which is displaceable in response to fluid pressure variations in a low pressure chamber which communicates with the inlet and displacement of said diaphragm causes a displacement of the biased sensing member of the second sensing means.

12. An assembly as claimed in claim 1 in which the switch means is biased to its first condition and each of the first and second pressure sensing means comprise respective members which are displaceable in response to variations in fluid pressure which react on the respective first and second pressure sensing means and displacement of said members from a predetermined condition adjusts the switch means from the first condition to the second condition of the switch means.

13. An assembly as claimed in claim 12 in which the respective displaceable members of the first and second sensing means control actuation of the switch means through a lever mechanism which is biased for the switch means, normally, to be in its first condition.

14. An assembly as claimed in claim 13 in which the lever mechanism comprises a pivotally mounted rocking lever which is common to the displaceable members of the first and second pressure sensing means.

15. An assembly as claimed in claim 14 in which the displaceable sensing members of the first and the second pressure sensing means are substantially parallel and react on a rocking lever which extends between those members, said rocking lever being pivotally mounted to a housing of the assembly and arranged to control actuation of a microswitch means disposed between the displaceable sensing members.

16. An assembly as claimed in claim 8 in which the biasing of the displaceable member of the first pressure sensing means is adjustable.

17. An assembly as claimed in claim 9 in which the biasing of the displaceable member of the second pressure sensing means is adjustable.

18. A liquid dispensing system having an assembly as claimed in claim 1 and comprising a source of liquid to be dispensed, electrically controlled fluid pressurising means controlled by the switch means for supplying liquid from the source under pressure to the inlet of the assembly and a dispensing tap communicating with the outlet of the assembly.

19. A system as claimed in claim 18 in which the fluid pressurising means is an electric pump.

20. A system as claimed in claim 18 in which the liquid is a beverage.

* * * * *

UNITED STATES PATENT AND TRADEMARK OFFICE

CERTIFICATE OF CORRECTION

PATENT NO. : 4,811,862

DATED : March 14, 1989

INVENTOR(S) : Brian R. Rutty and John J. Walshe

It is certified that error appears in the above-identified patent and that said Letters Patent is hereby corrected as shown below:

Title page:

Please change Assignee from: Arthur Guinness Son and Company Limited, to Arthur Guinness Son and Company (Great Britain) Limited.

Signed and Sealed this

Twenty-sixth Day of December, 1989

*Attest:*

JEFFREY M. SAMUELS

*Attesting Officer*

*Acting Commissioner of Patents and Trademarks*